United States Patent [19]

Solovieff

[11] 3,948,066

[45] Apr. 6, 1976

[54] DOOR LOCK

[76] Inventor: Paul G. Solovieff, 14291 Browning Ave., Apt. No. 52, Tustin, Calif. 92680

[22] Filed: May 7, 1974

[21] Appl. No.: 467,806

[52] U.S. Cl. ..... 70/129; 70/134; 70/391; 70/DIG. 42; 292/139; 292/165; 292/167; 292/DIG. 62

[51] Int. Cl.²E05B 63/08; E05B 63/16; E05B 65/06; E05C 1/06

[58] Field of Search ..... 70/129, 134, 156, 379, 70/380, DIG. 52; 292/139, 165, 167, DIG. 49

[56] References Cited

UNITED STATES PATENTS

| | | | |
|---|---|---|---|
| 1,518,395 | 12/1924 | Dexter | 70/129 |
| 1,702,211 | 2/1929 | Jakopec et al. | 292/DIG. 49 |
| 1,782,776 | 11/1930 | Dowling | 292/DIG. 49 |
| 1,876,803 | 9/1932 | VonMehren | 70/380 |
| 2,163,121 | 6/1939 | Holtzman | 70/134 |
| 2,296,020 | 9/1942 | Carter | 70/134 X |
| 2,623,379 | 12/1952 | Lucius | 70/134 |
| 2,842,951 | 7/1958 | Duvall | 70/379 R |
| 2,969,666 | 1/1961 | Muessel | 70/134 X |
| 2,991,643 | 7/1961 | Hitt | 70/134 |
| 3,768,285 | 10/1973 | Schwartz | 70/134 |

FOREIGN PATENTS OR APPLICATIONS

| | | | |
|---|---|---|---|
| 1,182,845 | 3/1970 | United Kingdom | 70/380 |

*Primary Examiner*—Paul R. Gilliam
*Assistant Examiner*—Carl F. Pietruszka
*Attorney, Agent, or Firm*—Fulwider, Patton, Rieber, Lee & Utecht

[57] ABSTRACT

A door lock having two escutcheon plates clamped against the sides of a door, two mortise cylinders mounted in coaxial relation in the escutcheon plates and each having a rotatable key plug and an actuating arm on the inner end of the plug, a bolt slidable between extended and retracted positions, and a toggle joint bolt-operating mechanism actuated by the actuating arms on the key plugs. This mechanism includes a bolt link pivotally connected to the inner end of the bolt, and an actuating link between the ends of the key plugs having abutment means for coupling and uncoupling of the arms and the actuating link which is urged in toward the locked and unlocked positions by a toggle spring movable into oppositely over-center positions. The abutment means comprise two spaced tabs defining a slot into which the actuating arm is eccentrically extended and retracted during rotation of the key plug through full locking and unlocking revolutions.

12 Claims, 11 Drawing Figures

Fig. 1
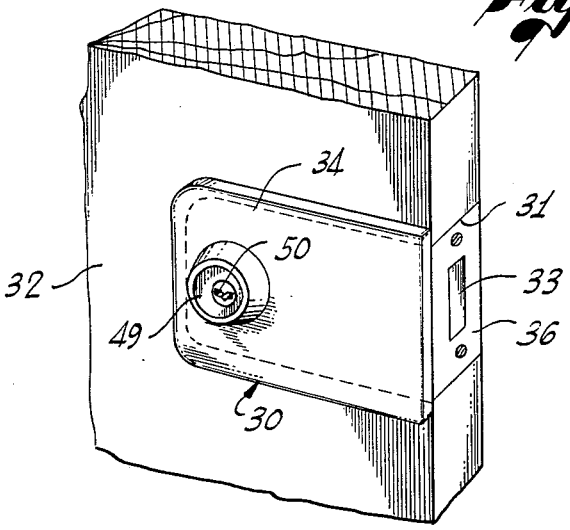
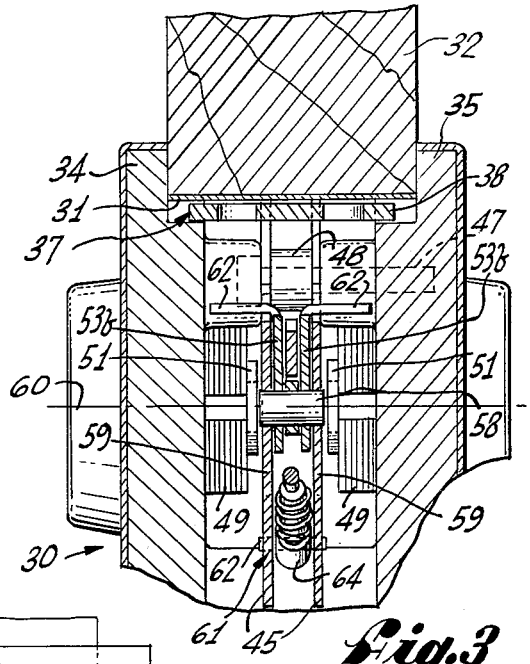
Fig. 3
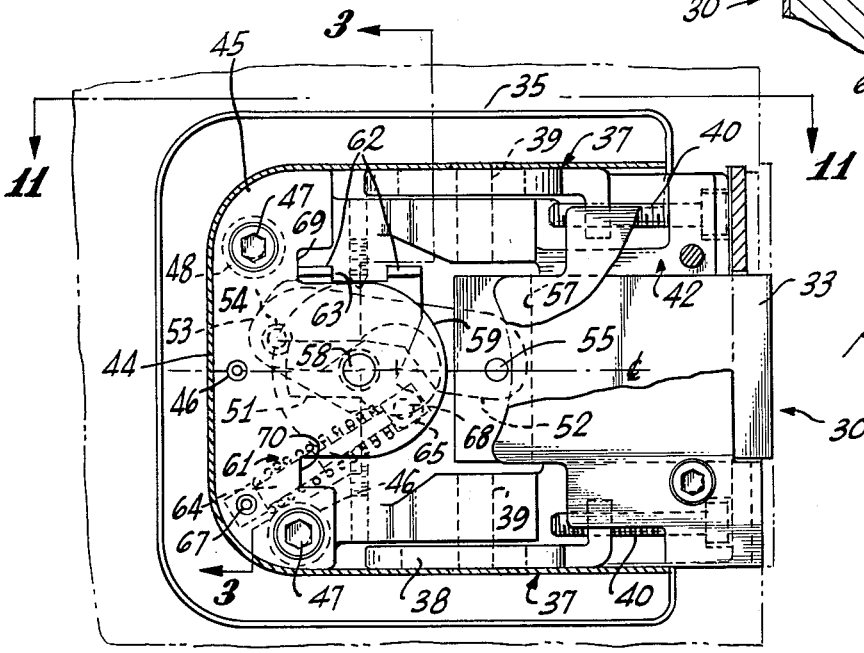
Fig. 2
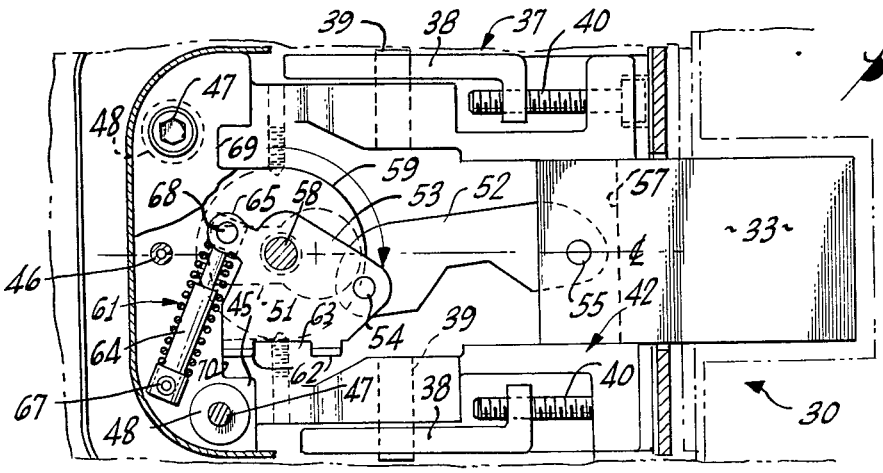
Fig. 4

DOOR LOCK

BACKGROUND OF THE INVENTION

This invention relates to door locks, and has particular reference to a door lock of the type that is mountable in a notch in one edge portion of a door and is key-operable from at least one side to extend and retract a slidable bolt.

The invention is particularly well suited for use in a high-security lock of the type shown in U.S. Pat. No. 3,702,549, in which two escutcheon plates form the sides of the lock housing and are joined together and clamped against the sides of the door by camming devices between the plates. These devices are operable from the edge of the door when the door is open, and a finish edge plate then in installed to close the lock at the door edge.

The lock of the aforesaid patent and the lock of the present invention are designed for optimum strength, security, and effectiveness of operation, rather than for highly price-competitive situations. At the same time, compactness in construction, and smooth, trouble-free performance are important considerations, along with design features that protect the lock from tampering that might make unauthorized entry possible.

In general, at least one mortise cylinder having a key-actuated plug therein is mounted on one of the escutcheon plates, and drives a bolt-operating mechanism inside the lock to extend and retract the bolt upon turning of the key. In the lock of the aforesaid patent, the key plug carries an arm that is pivotally connected by a link to the bolt, to push and pull the bolt as the plug is turned and the arm on the key plug swings toward and away from the bolt.

The primary objective of the present invention is to improve upon the bolt-operating mechanism of the patent while retaining the advantages of that mechanism, to provide a rugger, smooth-operating and highly tamper-resistant lock that has a substantially greater bolt-throw and improved keying motions.

SUMMARY OF THE INVENTION

The present invention resides in a door lock of the foregoing character which employs a toggle joint, apart from the actuating arm, as the bolt-operating mechanism, and in which a link of the toggle joint is pivotally mounted in the lock, alongside the inner end of the key plug, to be coupled to, and uncoupled from, an actuating arm on the key plug as the latter is rotated by the key. Rotation of the actuating link by the actuating arm moves the toggle joint selectively between, and leaves the joint in, a bolt-extending, locked position and a bolt-retracting, unlocked position, toward each of which the toggle joint is urged by a toggle spring, preferably acting on the actuating link.

More specifically, and as shown herein as the preferred embodiment of the invention, the actuating link is pivotally mounted in the lock beside the inner end of the key plug, in axially offset relation with the key plug, and has abutment means thereon defining an aperture into which the actuating arm is extended and retracted as an incident to the eccentric rotation of the arm relative to the link. The arm becomes coupled to the link during the initial rotation of the key plug, drives the link during a substantial portion of a revolution, herein about 180 degrees, and then is uncoupled from the link for return to its initial position by continued rotation in one direction. Unlocking is accomplished simply by reverse rotation of the plug and the arm, with the same coupling, driving and uncoupling operations.

With this arrangement, the amount of rotation available for bolt operation is greater than prior locks of comparable types, so the amount of available bolt throw can be correspondingly increased. Moreover, the positive coupling of the arm to the link during the driving portion of the revolution prevents return and removal of the key while the bolt is in a partially extended position.

The preferred form of the coupling abutment means is a pair of elongated, parallel tabs on the actuating link projecting toward the mortise cylinder to lie in the path of the actuating arm. When the lock is to be operable from both sides, two sets of such arms are provided on opposite sides of the actuating link.

The preferred toggle spring is a coiled spring fitted over a telescoping support pin that is pivoted at one end on the lock structure and at the other end on the actuating link, with the spring acting between the lock structure and the link to urge the latter toward oppositely over-center positions. This spring assists in the final portions of bolt extension and bolt retraction, and cooperates with stop means in the lock in determining the opposite extreme positions of the link.

Other aspects and advantages of the present invention will become apparent from the following detailed description, taken in conjunction with the accompanying drawings.

BRIEF DESCRIPTION OF THE DRAWINGS

FIG. 1 is a fragmentary perspective view of a door lock embodying the novel features of the present invention, after installation in a door;

FIG. 2 is a cross-sectional view of the lock, taken in a vertical plane alongside the bolt, with the bolt retracted and with parts broken away and shown in section;

FIG. 3 is a fragmentary cross-sectional view taken substantially along line 3—3 of FIG. 2;

FIG. 4 is a view similar to FIG. 2, but with the bolt extended;

DETAILED DESCRIPTION OF THE FIRST EMBODIMENT

Figure 5:
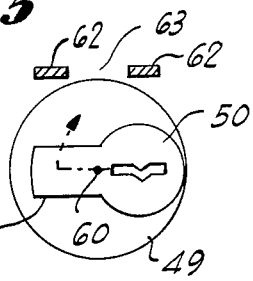
FIGS. 5 through 9 are views taken in a plane adjacent the end of the key plug and diagrammatically illustrating the progression of positions of the actuating arm and the coupling abutments as the bolt is moved between the retracted and extended positions.
Figure 6:
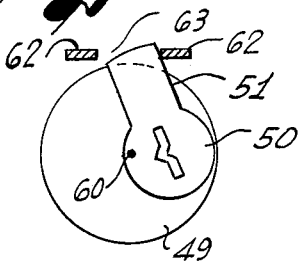
Figure 7:
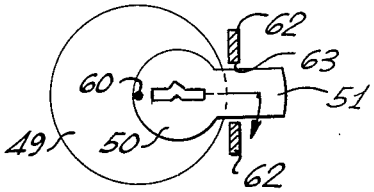

As shown in the drawings for purposes of illustration, the invention is embodied in a high-security door lock of the dead-bolt type, indicated generally by the reference numeral 30 and installed in a notch 31 in one edge portion of a door 32 for operation by a key (not shown), from at least one side of the door, to extend and retract a bolt 33. When extended, the bolt is engageable with a socket or keeper (not shown) mounted in the usual manner in an adjacent door frame, thereby to lock the door.

The main components of the lock 30 are two escutcheon plates 34 and 35 that are disposed against the opposite sides of the door, two camming devices 37 joining the escutcheon plates together and clamping them against the door 32, a finish edge plate 36 closing the open side of the lock at the edge of the door, and mechanism for extending and retracting the bolt to lock and unlock the door. The devices for clamping the escutcheon plates in this type of lock are known, having been disclosed in U.S. Pat. No. 3,702,549, and are shown herein only as parts of one lock structure for which the invention is particularly well suited. For details, reference is made to that patent, it being sufficient for present purposes to state that these devices comprise cam plates 38 engageable with followers 39 on the escutcheon plates to draw the latter together as the cam plates are drawn toward the edge of the door by screw actuators 40.

Figure 11:
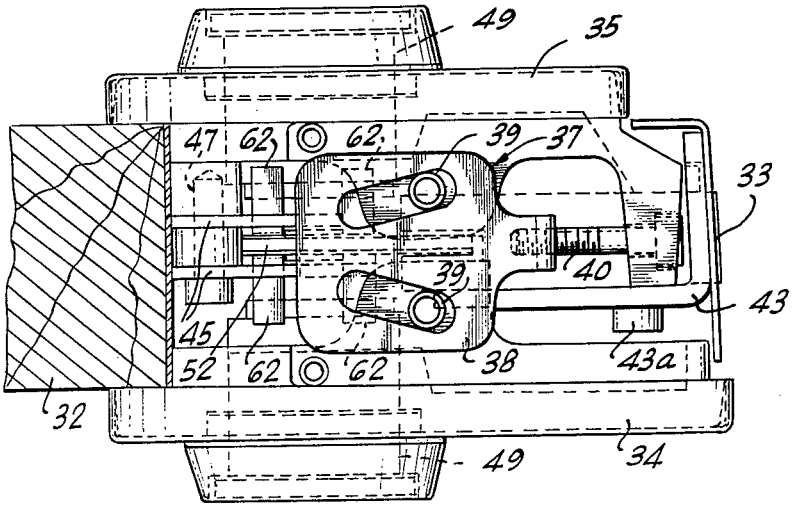
FIG. 11 is a fragmentary cross-sectional view taken substantially along line 11—11 of FIG. 2.

As shown most clearly in FIG. 4, the bolt 33 is a metal bar that is mounted in the lock for in-and-out sliding in a guideway 41 defined by a casting 42 that is secured to one of the escutcheon plates. A bolt retainer 43 is fastened to the casting by cap screws 43*a* (see FIG. 11), and formed with an opening through which the bolt projects. Preferably a U-shaped housing 44 closes the top, bottom and left side of the space between the escutcheon plates 34 and 35, and two specially shaped internal side plates 45 are mounted in spaced relation between the escutcheon plates, by a key pin 46, screws 47, and spacers 48, to support internal components of the lock.

The locking mechanism includes at least one mortise cylinder 49 mounted on one of the escutcheon plates. The mortise cylinder may be of a conventional type having a rotatable key plug 50 that serves as an actuating element for the mechanism, and is formed with a keyway of the usual type, to receive the key with which the plug is rotated. Herein, the lock is adapted for key operation from each side, and a mortise cylinder 49 is provided on each escutcheon plate. These mortise cylinders are mounted in end-to-end relation, with their key plugs 50 coaxial, and with their inner ends spaced apart on opposite sides of a central space in the lock.

Each key plug 50 carries on its inner end an actuating member in the form of an arm 51 that projects radially from the plug and rotates with the plug to actuate the bolt 33, through a toggle joint comprising two links 52 and 53. These links are pivotally connected by a pin 54 which forms the "knee" of the joint, and the link 52 is pivotally connected to the inner end portion of the bolt by a pin 55, preferably in a vertical groove 57 in the end of the bolt. The link 53, which is the actuating link of the toggle joint, has coupling abutment means thereon engageable by the actuating arms 51, and is pivoted on a pin 58 mounted in a fixed position in the lock between generally semi-circular projections 59 on the two supporting plates 45. The pin 58 thus defines an axis 60 for the actuating link that is parallel to the axes of the key plugs 50 and perpendicular to the direction of movement of the bolt. The axis 60 is, however offset from the axes of the key plugs, away from the bolt 33.

With this arrangement, rotation of the actuating link 53 back and forth between the two positions shown in FIGS. 2 and 4 extends and retracts the bolt 33 by swinging the knee pin 54 along an arc between the two pin positions shown in FIGS. 2 and 4. When the link 53 is in the retracted position shown in FIG. 2, the knee pin is shifted to the left to retract the bolt, and a notch in the underside of the bolt link 52 overlies the pin 58 to latch the bolt securely in the retracted position.

When the link is in the extended position shown in FIG. 4, the knee pin is shifted to the right and the bolt is extended. A toggle spring 61 acts on the actuating link to urge the toggle joint in each direction after it passes a central position in which the knee pin 54 is in line with the pins 52 and 58. It will be evident, however, that other springing or detenting arrangements may be substituted for the preferred spring arrangement.

Preferably, the actuating link 53 comprises two flat plates 53*a* and 53*b* (see FIG. 3) that are mounted on the pin 58 for rotation in unison about the axis 60, and each of these plates has coupling means engageable with the adjacent actuating arm 51 during rotation of the adjacent key plug 50. In the preferred embodiment, shown in FIGS. 1 through 11, the coupling means comprise two spaced tabs 62 on each plate projecting laterally toward the adjacent escutcheon plates 34, 35 and defining a slot 63 for receiving the actuating arm 51 as the latter rotates, straddling the arm as the actuating link is moved from one position to another, and releasing the actuating arm when the link reaches the new position. The tabs are long enough to receive the actuating arms in a range of spacings of the escutcheon plates from each other, due to varying door thicknesses.

This engage-and-release action while the key and the actuator arm 51 are making a full revolution is achieved as a result of offset of the axis 60 of the actuating link from the rotational axes of the actuating arms, away from the bolt 33, so that each of the arms has, in effect, an eccentric motion relative to the tabs 62, radially outwardly relative to the tabs during part of each revolution and radially inwardly during the remainder. This makes it possible to extend an arm into the slot 63 during the initial portion of the revolution, and to retract it from the slot after the link has been moved to its new position.

Figure 8:
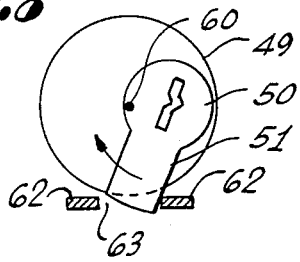
Figure 9:
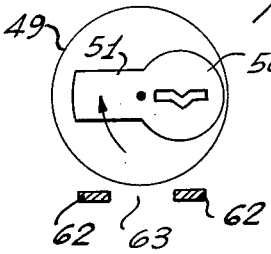
Figure 10:
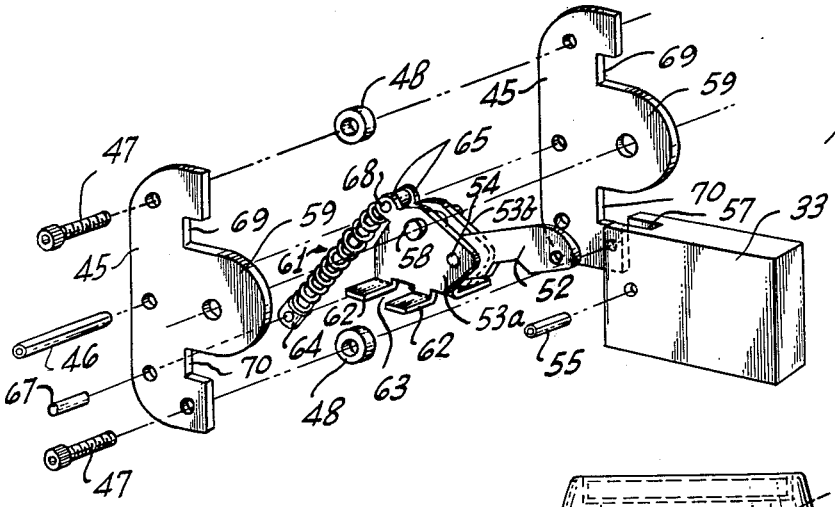
FIG. 10 is an exploded perspective view of the principal components of the bolt-operating mechanism.

This action is illustrated in FIGS. 5 through 9, wherein it will be seen that the actuating arm 51 begins in a horizontal position projecting to the left (FIG. 5), the tabs 62 being shown in the unlocked position above the mortise cylinder 49. As the key plug 50 is turned clockwise, the arm 51 swings up and enters the slot 63 (FIG. 6), engaging the left edge of the right tab to begin pushing the tab clockwise toward the locked position. As clockwise motion continues, the arm is inserted fully between the tabs and moves through the position shown in FIG. 7, in which the tabs are half way to the locked position (FIG. 8). As the locked position is reached, the eccentric motion of the arm results in withdrawal or retraction of the arm from the slot, leaving the link 53 in the locked position as the arm continues to the starting position.

Unlocking is effected in the same way, except that the direction of rotation is reversed, counter-clockwise from the position in FIG. 5 through the FIG. 8 position where the arm picks up the link. Then the arm continues on through the FIG. 6 position where the link is released, and is moved back to the FIG. 5 position.

It is important to note that the movement of the link 53 is through a full 180 degrees, which optimizes the amount of bolt "throw" available for high security. The amount of throw also is affected by the amount of movement of the knee pin 54, longitudinally of the direction of bolt movement, from its starting position (FIG. 2) to its locked position (FIG. 4). Since the link extends almost directly to the left in the starting position, and almost directly to the right in the locked position, the amount of bolt throw is almost twice the radius of rotation of the knee pin. After the link goes over-center, of course, a slight amount of bolt retraction occurs.

It also should be noted that this embodiment provides positive protection against the return of the key plug 50 to the initial position before the actuating arm 51 is withdrawn from the slot 63. The trailing tab 62 during the locking operation traps and confines the arm 51, so that return rotation of the arm necessarily retracts the bolt 33, thus preventing anyone from returning and removing the key with the bolt in a partially locked position in which it can be externally forced back to the unlocked position.

The toggle spring 61 may take various forms, a preferred form being shown in FIGS. 1 through 4 and 10 through 12. Basically, this is a coiled compression spring which is fitted over a two-piece, telescoping pin 64, in abutment with the head of the pin at one end, and with the adjacent edges of two ears 65 on the link plates 53*a*, 53*b* at the other end. The telescoping pin 64 is pivoted at its head end on a pin 67 that is mounted in the plates 45, and is pivoted at the other end on a pin 68 mounted between the two ears, this pin forming the "knee" of the toggle spring.

When the link 53 is in the retracted position (FIG. 2), the spring 61 is inclined upwardly and to the right, generally under the axis, and presses against the ears 65 to urge the link counterclockwise about the pin 58, thus holding the link yieldably in the unlocked position. As the link is rotated clockwise toward the locked position, the ears 65 move to the left, compressing the spring, as permitted by longitudinal contraction of the telescoping pin 64, which swings to the left about its base pivot pin 67.

The spring continues to resist rotation of the link 53 until the knee pin 68 moves onto a line between the base pivot 67 and the link pivot 58, at which time the spring force is neutralized. After the knee pin 68 crosses this line, the toggle spring is over-center, and the effective direction of the spring force on the link 53 is reversed. Thus, the compressed spring now acts to drive the link clockwise, and expands in doing so, until the link 53 reaches its locked position, shown in FIG. 4. In this position, the spring is inclined upwardly and across the side of the pivot pin generally opposite its starting position.

Suitable stops 69 and 70 are provided for limiting the rotation of the actuating link 53 in each direction, and thus determining the positions of the bolt-operating mechanism in the locked and unlocked conditions. Herein, these stops are edge surfaces on the two internal support plates 45, disposed in the paths of the tabs 62 and engageable with the latter when the lock is locked and unlocked. As shown in FIGS. 2 and 4, these edges are the bottoms of notches in the internal support plates 45, at the bases of the semi-circular projections 59 about which the tabs travel during the locking and unlocking operations. The toggle spring 61 holds the tabs firmly against one set of the stops in each condition of the lock.

Through a comparison of the angular distances the knee pins 54 and 68 travel after passing over their respective center lines during locking, it will be evident that the spring 61 becomes effective to assist locking rotation before the bolt 33 has been fully extended. Thus, the completion of bolt extension is spring assisted. In fact, the further motion of the link 53 after the bolt toggle goes over-center produces a small amount of bolt retraction, but this is insignificant in view of the substantial amount of bolt projection that is possible with the lock of the present invention.

From the foregoing, it will be seen that the improved bolt-operating mechanism of the present invention provides for a bolt throw utilizing substantially 180 degrees of rotation during the actuation of the bolt, and optimizes the resulting throw of the bolt. Moreover, the actuating link of the toggle joint is disposed beside the end of the mortise cylinder, between the cylinders when two are used, and is actuated by abutment means engaged by the actuating arms of the key plugs. This makes possible the eccentric insertion/retraction motions with the effective toggle actions of the spring 61 and the bolt toggle mechanism 52, 53.

It also will be evident that, while one embodiments has been illustrated and described, various modifications and changes may be made without departing from the spirit and scope of the invention.

I claim:

1. In a door lock having two side plates forming part of a housing for the lock, a bolt mounted between said side plates for sliding between a retracted, unlocked position and an extended, locked position, and at least one actuating element mounted on one of said plates for rotation about a first axis, and having an inner end that is disposed between said plates, an improved bolt-operating mechanism, comprising:

an actuating member carried by the actuating element on the inner end portion thereof and rotatable with the actuating element about said axis;

a toggle joint comprising first and second toggle links joined together by a first pivot;

a second pivot joining said first link to the inner end of said bolt;

a third pivot spaced inwardly from said bolt and mounting said second link in said housing alongside said inner end of said actuating element, for rotation about a second axis spaced from said first pivot, whereby back and forth rotation of said second link extends and contracts said toggle joint to extend and retract said bolt;

said second link being movable in a bolt-extending direction from a bolt-retracted position in which said first pivot is angularly spaced from a line between said second and third pivots, on one side of said line, to a bolt-extended position in which said first pivot is on the other side of said line;

spring means for urging said toggle joint yieldably toward the bolt-retracted position until the bolt is substantially extended, and toward the bolt-extended position after the bolt is substantially extended; and abutment means on said second link disposed in te path of rotation of said actuating member to be engaged and moved, along with the second link, to a selected bolt-extended position during rotation in one direction, and to be engaged and moved from said bolt-extended position to a selected bolt-retracted position during rotation in the other direction;

said second axis being offset from said first axis away from said bolt and the rotation of said actuating element being eccentric relative to the rotation of said abutment means on said second link; and said abutment means defining an aperture for receiving and releasing said actuating member as an incident to the eccentric rotation thereof, in said bolt-extended and bolt-retracted positions of said second link.

2. A door lock as defined in claim 1 in which said actuating member is an arm projecting radially from the inner end of said actuating element, for insertion in and retraction from said aperture during the eccentric rotation and said abutment means comprise two elongated and parallel tabs on said second link projecting toward said one of said plates, and defining a slot for receiving said arm as the latter is rotated.

3. A door lock as defined in claim 1 in which said spring means comprise a toggle spring including:

a telescoping support pin pivoted at one end in said lock and at the other end on said second link, and a spring mounted on said support pin and urging said second link away from said one end of said support pin, said toggle spring being positioned to go over-center and reverse the effective angular direction in which it urges said second link as said toggle joint is extending said bolt toward the locked position and retracting said bolt toward the unlocked position.

4. A door lock as defined in claim 3 in which said toggle spring is positioned to go over-center before said toggle joint goes over-center during locking of the bolt.

5. In a door lock having two side plates mountable against the opposite sides of a door adjacent one edge thereof, a bolt mounted between said plates for sliding between a retracted, unlocked position and an extended, locked position, and at least one actuating element mounted on one of said plates for rotation about a first axis and having an inner end that is disposed between said plates, an improved bolt-operating mechanism, comprising:

an actuating member carried by the inner end of said actuating element and projecting radially outwardly therefrom;

a toggle joint comprising first and second toggle links joined together by a first pivot;

a second pivot joining said first toggle link to the inner end of said bolt;

a third pivot spaced inwardly from said bolt and supporting said second link at a point on the second link spaced from said first pivot, for rotation about a fixed second axis that is parallel to said first axis and is offset therefrom away from said bolt, said third pivot being positioned adjacent the inner end of said actuating element to support said second link for eccentric rotation relative to said first axis;

said second link being movable in a bolt-extending direction from a bolt-retracted position in which said first pivot is angularly spaced from a line between said second and third pivots, on one side of said line, to a bolt-extended position in which said first pivot is aligned with said line;

abutment means on said second link projecting toward the side plate on which said actuating member is mounted and defining an aperture, said aperture being positioned, when said second link is in said bolt-retracted position, to receive said actuating member during the initial portion of the rotation of said actuating element from said one angular position, thereby to couple said second link to said actuating member for movement of said second link to said bolt-extended position;

said aperture also being positioned on said second link to release said actuating member due to said eccentric rotation as the link reaches said bolt-extended position, whereby the actuating element is rotatable on to said one angular position;

and spring means for urging said toggle joint yieldably toward the bolt-retracted position until the bolt is substantially extended, and toward the bolt-extended position after the bolt is substantially extended.

6. In a door lock having two escutcheon plates mountable against the opposite sides of a door adjacent one edge thereof, means for clamping said escutcheon plates together and against the sides of the door, a bolt mounted between said plates for sliding between a retracted, unlocked position and an extended, locked position, and at least one mortise cylinder secured in one of said escutcheon plates and having a key plug therein that is rotatable about a first axis and has an outer end for receiving a key in one angular position of said key plug and an inner end that is disposed between said escutcheon plates, an improved bolt-operating mechanism, comprising:

an actuating arm secured to the inner end of said key plug and projecting radially outwardly therefrom;

a toggle joint comprising first and second toggle links joined together by a first pivot;

a second pivot joining said first toggle link to the inner end of said bolt;

a third pivot spaced inwardly from said bolt and supporting said second link at a point on the second link spaced from said first pivot, for rotation about a fixed second axis that is parallel to said first axis and is offset therefrom away from said bolt, said third pivot being positioned adjacent the inner end of said key plug to support said second link for eccentric rotation relative to the axis of the key plug;

said second link being movable in a bolt-extending direction from a bolt-retracted position in which said first pivot is angularly spaced from a line between said second and third pivots, on one side of said line, to a bolt-extended position in which said first pivot is on the other side of said line;

a pair of spaced, parallel coupling tabs on said second link projecting toward the escutcheon plate on which said key plug is mounted and defining a slot between them, said tabs being positioned, when said second link is in said bolt-retracted position, to receive said actuating arm between them during the initial portion of the rotation of said key plug from said one angular position, thereby to couple said second link to said actuating arm for movement of said second link to said bolt-extended position;

said tabs also being positioned on said second link to release said actuating arm due to said eccentric rotation as the link reaches said bolt-extended position, whereby the key plug is rotatable on to said one angular position;

and spring means for urging said toggle joint yieldably toward the bolt-retracted position until the bolt is substantially extended, and toward the bolt-extended position after the bolt is substantially extended.

7. A door lock as defined in claim 6 in which said coupling tabs are positioned on said second link with said slot approximately ninety degrees on opposite sides of the line between said second and third pivots in said bolt-extended position and said bolt-retracted position.

8. A door lock as defined in claim 7 in which said first pivot is positioned on said second link to be disposed more than ninety and less than one hundred eighty degrees from said line when said second link is in said bolt-retracted position.

9. A door lock as defined in claim 6 in which said spring means comprise a telescoping spring support, means pivotally mounting one end of said support in said lock and the other end on said second link to move back and forth between oppositely over-center positions as said second link is moved between said bolt-extended and bolt-retracted positions, and a coiled compression spring fitted over said spring support and acting on said second link to urge the latter oppositely in said oppositely over-center positions.

10. A door lock as defined in claim 6 in which two mortise cylinders are mounted in substantially coaxial relation on said escutcheon plates, with the inner ends thereof spaced apart on opposite sides of said second link, and each having an actuating arm thereon, said second link having two pairs of spaced, parallel tabs projecting in opposite directions for coupling engagement with said actuating arms.

11. A door lock as defined in claim 10 in which said second link comprises two side-by-side plates mounted on said third pivot for movement in unison, and each having a pair of said tabs integrally formed thereon and bent at right angles to the plate to project toward the adjacent escutcheon plate.

12. A door lock as defined in claim 6 including stop means for determining both positions of said second link.

* * * * *

UNITED STATES PATENT AND TRADEMARK OFFICE

CERTIFICATE OF CORRECTION

PATENT NO. : 3,948,066

DATED : April 6, 1976

INVENTOR(S) : Solovieff, P.G.

It is certified that error appears in the above-identified patent and that said Letters Patent are hereby corrected as shown below:

Column 1, line 39, delete "rugger" and insert therefor --rugged--.

Column 5, line 1, delete "throw" and insert --"throw"--.

Column 6, line 55, delete "te" and insert therefor --the--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*